US010829865B2

(12) United States Patent
Kimura et al.

(10) Patent No.: US 10,829,865 B2
(45) Date of Patent: Nov. 10, 2020

(54) PADDLE FOR USE OF STIRRING PLATING SOLUTION AND PLATING APPARATUS INCLUDING PADDLE

(71) Applicant: EBARA CORPORATION, Tokyo (JP)

(72) Inventors: Risa Kimura, Tokyo (JP); Mitsuhiro Shamoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 16/254,232

(22) Filed: Jan. 22, 2019

(65) Prior Publication Data

US 2019/0271095 A1 Sep. 5, 2019

(30) Foreign Application Priority Data

Mar. 1, 2018 (JP) ..... 2018-036693

(51) Int. Cl.

| | |
|---|---|
| ***C25D 21/10*** | (2006.01) |
| ***C25D 17/00*** | (2006.01) |
| ***B01F 11/00*** | (2006.01) |
| ***C25D 21/12*** | (2006.01) |

(52) U.S. Cl.

CPC ..... *C25D 21/10* (2013.01); *B01F 11/0082* (2013.01); *B01F 11/0091* (2013.01); *B01F 11/0097* (2013.01); *C25D 17/001* (2013.01); *C25D 21/12* (2013.01); *B01F 2215/0096* (2013.01)

(58) Field of Classification Search

CPC ..... C25D 21/10; C25D 17/001; C25D 21/12; B01F 11/0082; B01F 11/0091; B01F 11/0097

See application file for complete search history.

(56) References Cited

U.S. PATENT DOCUMENTS

| | | | | |
|---|---|---|---|---|
| RE45,687 | E | 9/2015 | Saito et al. | |
| 2006/0113185 | A1* | 6/2006 | Kuriyama | C23C 18/1628 204/275.1 |
| 2009/0139871 | A1* | 6/2009 | Saito | C25D 21/10 205/148 |
| 2012/0199475 | A1* | 8/2012 | McHugh | C25D 17/001 204/273 |

FOREIGN PATENT DOCUMENTS

JP 2009-155726 A 7/2009

* cited by examiner

*Primary Examiner* — Ciel P Contreras
(74) *Attorney, Agent, or Firm* — BakerHostetler

(57) ABSTRACT

According to one embodiment, a plating apparatus for electroplating a substrate including a non-pattern area is provided. The plating apparatus includes a plating tank for holding the plating solution, an anode configured to be connected to a positive electrode of a power supply, and a paddle configured to move in the plating tank to stir the plating solution held in the plating tank. The paddle is configured such that at least a part of the non-pattern area of the substrate is constantly blocked when the paddle is viewed from the anode while the paddle is stirring the plating solution.

4 Claims, 15 Drawing Sheets

PADDLE FOR USE OF STIRRING PLATING SOLUTION AND PLATING APPARATUS INCLUDING PADDLE

CROSS-REFERENCE TO RELATED APPLICATION

This application is based upon and claims the benefit of priority of the prior Japanese Patent Application No. 2018-036693, filed on Mar. 1, 2018, the entire contents of which are incorporated herein by reference.

TECHNICAL FIELD

This application relates to a paddle used to stir a plating solution and a plating apparatus including the paddle. This application relates to a method for stirring the plating solution with the paddle at the time of electroplating and a plating method.

BACKGROUND ART

In a production of a semiconductor device, various processes are performed on a circular substrate compliant to, for example, the SEMI standard to form the semiconductor device. On the other hand, recently, the semiconductor device has been produced using a square substrate, not the circular substrate. Using a square substrate in a large size ensures formation of multiple devices with the one substrate. FIG. 1 illustrates an exemplary quadrilateral substrate Wf. The square substrate Wf illustrated in FIG. 1 includes six pattern areas 302. The respective pattern areas 302 are surrounded by a non-pattern area 304. Here, the pattern area is an area used as a device on the substrate, and the non-pattern area is an area that is not used as the device on the substrate. In the production of the device, the substrate is conveyed to a plurality of processing devices, and various processes are performed on the substrate in the respective processing devices. When the substrate is conveyed, the non-pattern area, which is provided on an outer peripheral portion of the substrate, is typically supported to hold and move the substrate. In the case of the large substrate, when the substrate is supported at the non-pattern area on the outer peripheral portion, the substrate may bend and warp to cause a possibility that influences the device in the pattern area. Therefore, when the square substrate in a large size is used, as illustrated in FIG. 1, the non-pattern area is sometimes provided not only on the outer peripheral portion of the substrate, but also in an inner region of the substrate to support the non-pattern area in the inner region of the substrate in addition to the non-pattern area on the outer peripheral portion of the substrate for conveyance of the substrate.

In the production of the semiconductor device, electroplating may be used. An electroplating method can easily obtain a metal film (plating film) with a high purity. Moreover, a film formation speed of the metal film is relatively fast, and a thickness of the metal film also can be relatively easily controlled. In the metal film formation on a semiconductor wafer, in order to seek high-density packaging, high-performance, and a high yield, an in-plane uniformity of the film thickness is also required. The electroplating is expected that a metal film excellent in the in-plane uniformity of the film thickness can be obtained by uniformizing metal-ion-supply-rate distribution and electric potential distribution of a plating solution. In the electroplating, in order to control an electric field in the plating solution, a regulation plate formed of, for example, a dielectric material may be used. In the electroplating, in order to uniformly supply the substrate with a sufficient amount of ion, the plating solution may be stirred. In order to stir the plating solution while controlling the electric field in the plating solution, a plating apparatus including a regulation plate and a paddle for stirring has been known (PTL 1).

CITATION LIST

Patent Literature

PTL 1: Japanese Unexamined Patent Application Publication No. 2009-155726

SUMMARY OF INVENTION

Technical Problem

As described above, in the electroplating, a method for performing the electroplating while controlling the electric field with the regulation plate and stirring the plating solution with the paddle has been known. In the electroplating, when there is a large non-pattern area inside the substrate, a thickness of the plating film formed by the electroplating tends to increase in a plating area near the non-pattern area, and thus, uniform plating sometimes cannot be sufficiently achieved in a conventional electric field control with the regulation plate. One object of this application is to improve an in-plane uniformity with a paddle that stirs a plating solution.

Solution to Problem

According to one embodiment, a plating apparatus for electroplating a substrate including a non-pattern area is provided. The plating apparatus includes a plating tank that holds a plating solution, an anode configured to be connected to a positive electrode of a power supply, and a paddle configured to move in the plating tank to stir the plating solution held in the plating tank. The paddle is configured such that at least a part of the non-pattern area of the substrate is constantly blocked when the paddle is viewed from the anode while the paddle is stirring the plating solution.

DESCRIPTION OF EMBODIMENTS

Figure 1:
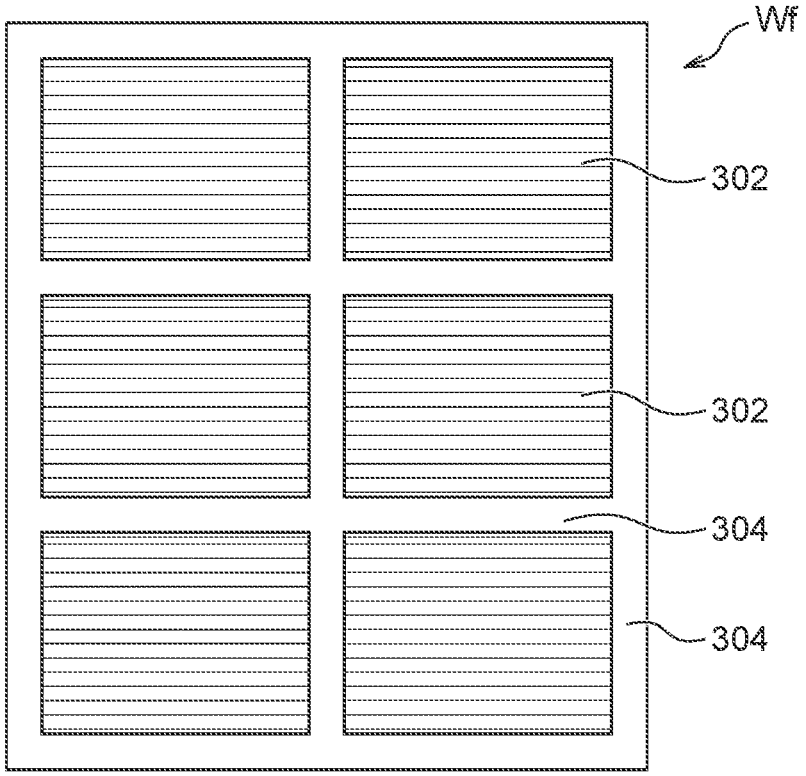
FIG. 1 is a front view illustrating an exemplary quadrilateral substrate.

The following describes embodiments of a paddle for use of stirring a plating solution and a plating apparatus including the paddle according to the present invention with the attached drawings. In the attached drawings, identical or similar reference numerals are attached to identical or similar components, and overlapping description regarding the identical or similar components may be omitted in the description of the respective embodiments. Features shown in the respective embodiments are applicable to other embodiments in so far as they are consistent with one another.

Figure 2:
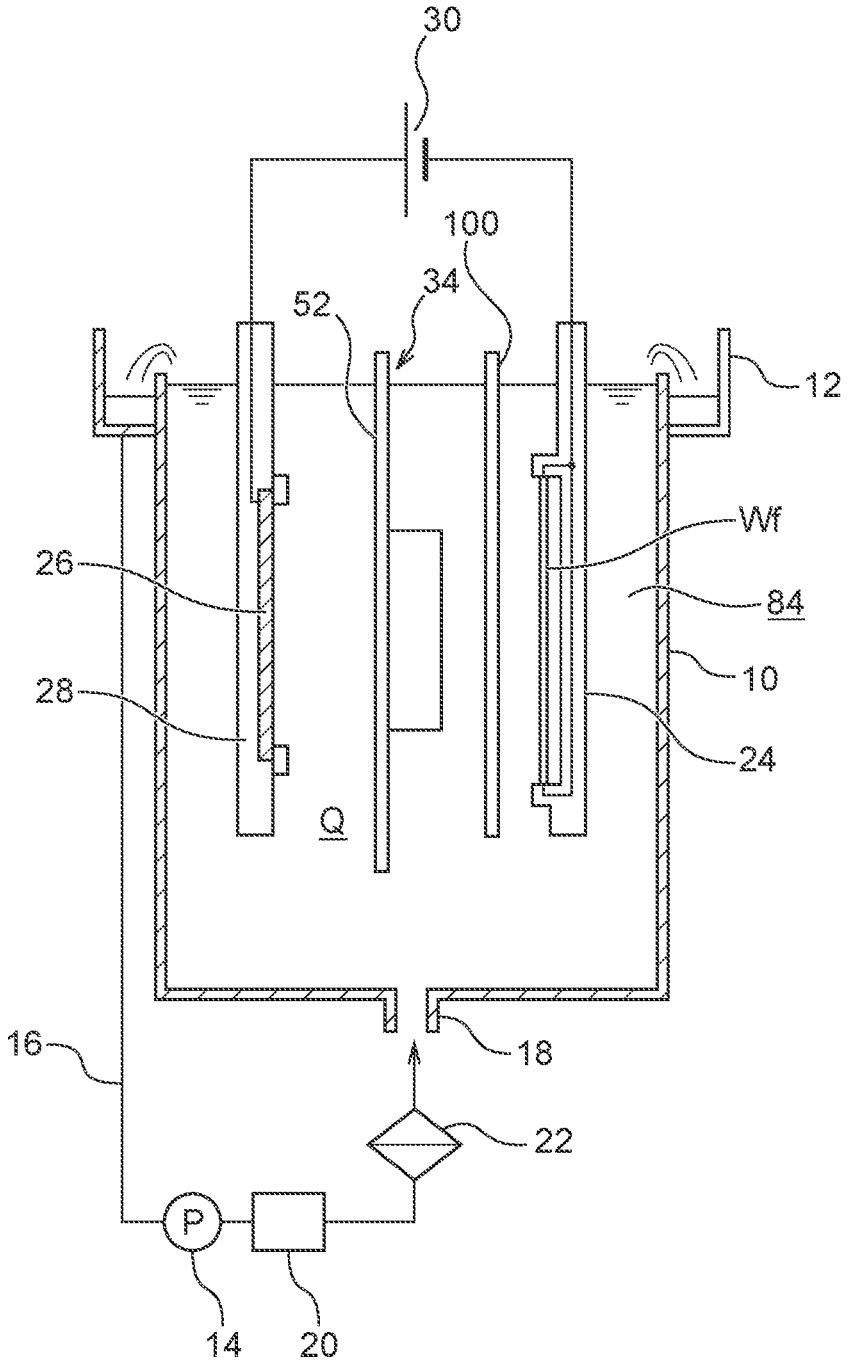
FIG. 2 is a drawing schematically illustrating a plating apparatus according to one embodiment.

FIG. 2 is a drawing schematically illustrating a plating apparatus according to one embodiment. The plating apparatus can be, for example, a plating apparatus for plating copper on a surface of a semiconductor substrate using a plating solution Q containing copper sulfate. As illustrated in FIG. 2, the plating apparatus includes a plating tank 10 that internally holds the plating solution Q. An overflow tank 12, which receives the plating solution Q that has overflowed from an edge of the plating tank 10, is disposed on an upward outer periphery of the plating tank 10. One end of a plating solution supply passage 16 including a pump 14 is connected to a bottom portion of the overflow tank 12. Another end of the plating solution supply passage 16 is connected to a plating solution inlet 18 provided on a bottom portion of the plating tank 10. This returns the plating solution Q accumulated in the overflow tank 12 into the plating tank 10 with driving of the pump 14. The plating solution supply passage 16 includes a thermostat 20, which is positioned on a downstream side of the pump 14 and adjusts a temperature of the plating solution Q, and a filter 22, which filters and removes a foreign object in the plating solution.

The plating apparatus includes a substrate holder 24 that attachably and removably holds a substrate (body to be plated) Wf to immerse the substrate Wf in a vertical state in the plating solution Q in the plating tank 10. An anode 26 is arranged at a position opposed to the substrate Wf, which is held by the substrate holder 24 in the plating tank 10 to be immersed in the plating solution Q. The anode 26 is held onto an anode holder 28 to be immersed in the plating solution Q. As the anode 26, in this example, phosphorus-containing copper is used. The substrate Wf is electrically connected to the anode 26 via a plating power supply 30. Flowing current between the substrate Wf and the anode 26 forms a plating film (copper film) on a surface of the substrate Wf.

A paddle 100, which is reciprocated parallel to the surface of the substrate Wf to stir the plating solution Q, is arranged between the substrate Wf, which is arranged with being held by the substrate holder 24 to be immersed in the plating solution Q, and the anode 26. Thus, stirring the plating solution Q with the paddle 100 can uniformly supply the surface of the substrate Wf with sufficient copper ions. A distance between the paddle 100 and the substrate Wf is preferably 1 mm to 20 mm. Further, a regulation plate 34, which is formed of a dielectric material to more uniform electric potential distribution over the whole surface of the substrate Wf, is arranged between the paddle 100 and the anode 26.

Figure 3:
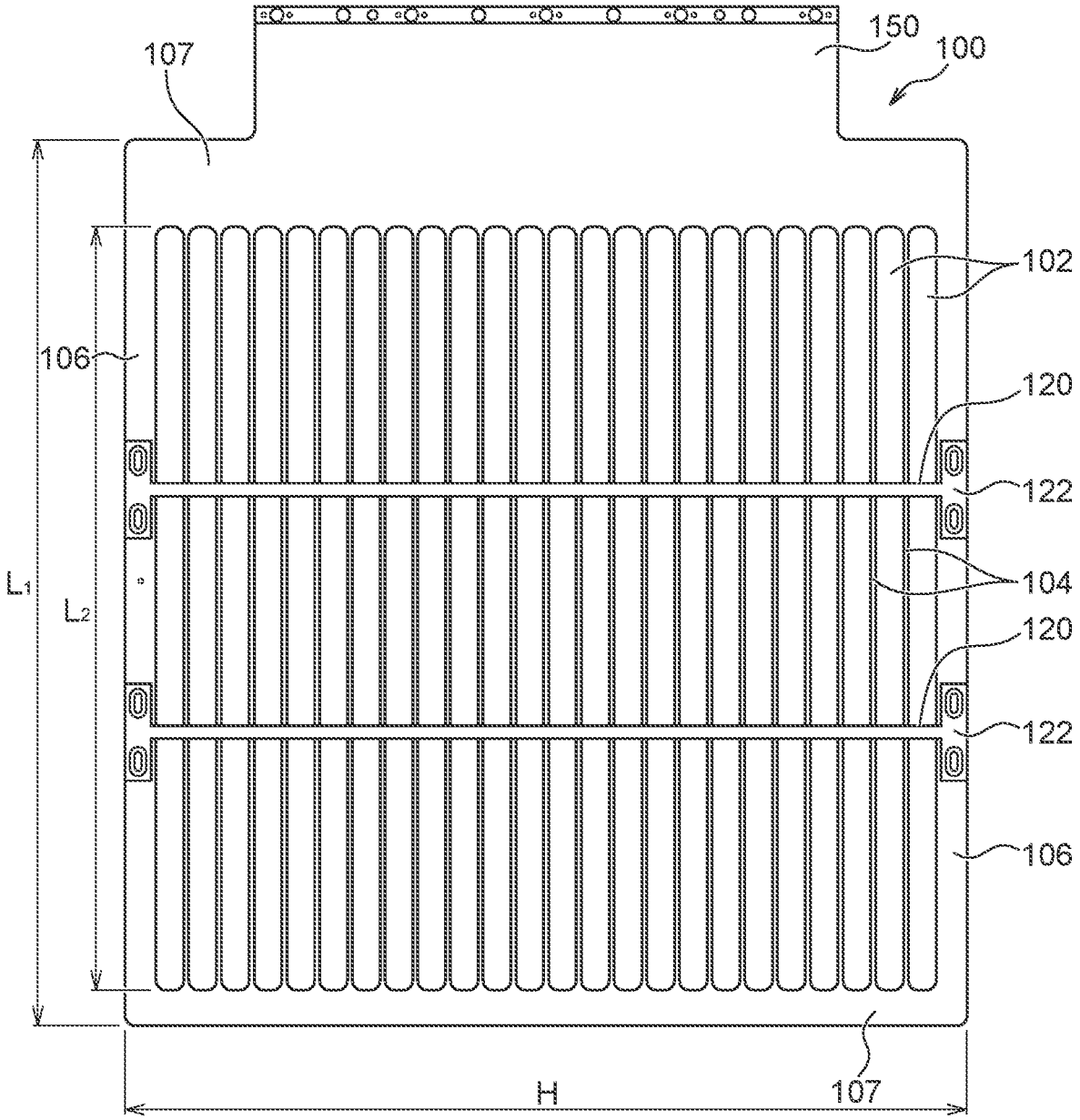
FIG. 3 is a drawing illustrating a paddle illustrated in FIG. 2 from its front (a lateral direction in FIG. 2)

FIG. 3 is a drawing illustrating the paddle 100 illustrated in FIG. 2 from its front (a lateral direction in FIG. 2). The paddle 100 is configured from a rectangular plate-shaped member having a plate thickness (a dimension in the lateral direction in FIG. 2) that has a constant thickness of 3 mm to 12 mm. As illustrated in FIG. 3, the paddle 100 is configured such that a plurality of elongated holes 102 are provided parallel inside and a plurality of grid portions 104 extending in a vertical direction are disposed. As illustrated in FIG. 3, the plurality of elongated holes 102 of the paddle 100 are surrounded by outer peripheral portions 106 and 107. For convenience, outer peripheral portions in a traverse direction of the elongated hole 102 are described as the outer peripheral portions 106, and outer peripheral portions in a longitudinal direction of the elongated hole 102 are described as the outer peripheral portions 107. A material of the paddle 100 can be obtained by, for example, coating titanium with Teflon (registered trademark). A length L1 in a perpendicular direction of the paddle 100 and a dimension L2 in the longitudinal direction of the elongated hole 102 are set sufficiently larger than a dimension in a perpendicular direction of the substrate Wf (see FIG. 1). A length H in a lateral direction of the paddle 100 is set such that the length H is sufficiently larger than a lateral length of the substrate Wf plus an amplitude length (stroke St) of the reciprocation of the paddle 100 (reciprocation in a right-left direction in FIG. 3).

A width and the number of the elongated hole 102 are preferably determined such that the grid portion 104 is as thin as possible in a range where the grid portion 104 has a necessary rigidity so that the grid portion 104 between the elongated hole 102 and the elongated hole 102 efficiently stirs the plating solution to efficiently pass the plating solution through the elongated hole 102. Thinning the grid portion 104 of the paddle 100 is important to reduce an influence from formation of a shadow (position where the electric field does not influence or the influence of the electric field is little) of the electric field on the substrate Wf, when a moving speed of the paddle 100 decreases or the paddle 100 instantaneously stops near both ends of the reciprocation of the paddle 100.

The paddle 100 has a thickness (plate thickness) t that is preferably thin to bring the regulation plate 34 close to the substrate Wf and can be set to, for example, 3 mm to 12 mm. In the one embodiment, the thickness t of the paddle 100 can be set to 6 mm. Uniformizing the thickness t of the paddle 100 can prevent liquid splash of the plating solution Q and large liquid shake of the plating solution Q. A neck portion 150, which has a dimension in the lateral direction that is relatively small, is disposed above an area on which the elongated holes 102 are provided of the paddle 100. Clamps 36 are secured to the neck portion 150 as described below.

Figure 4:
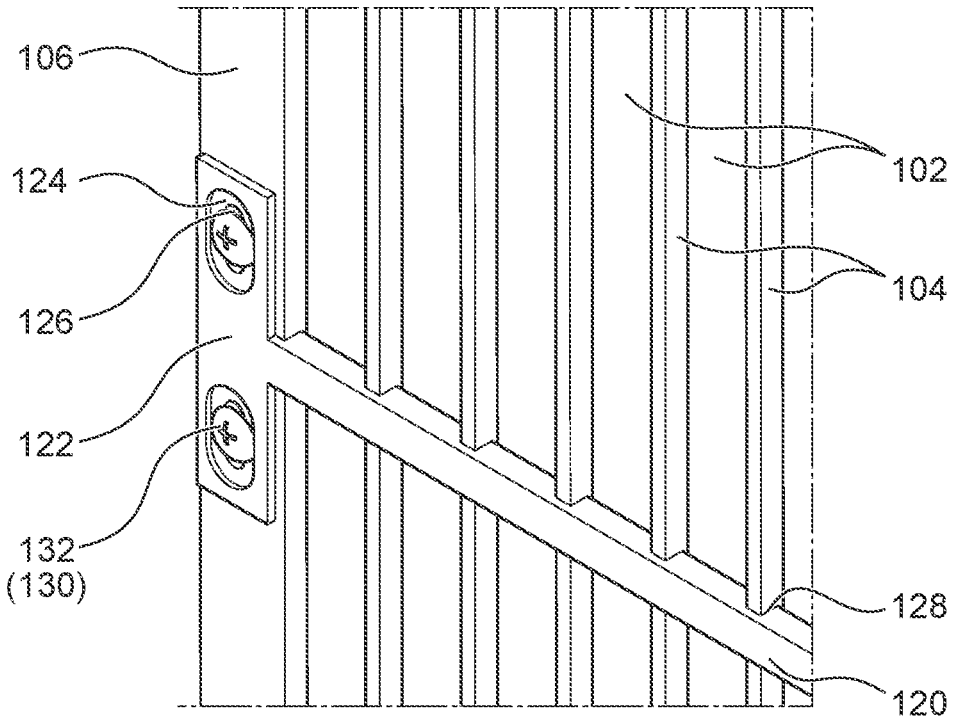
FIG. 4 is an enlarged perspective view illustrating a part of a mounted portion of a rib illustrated in FIG. 3.
Figure 5:
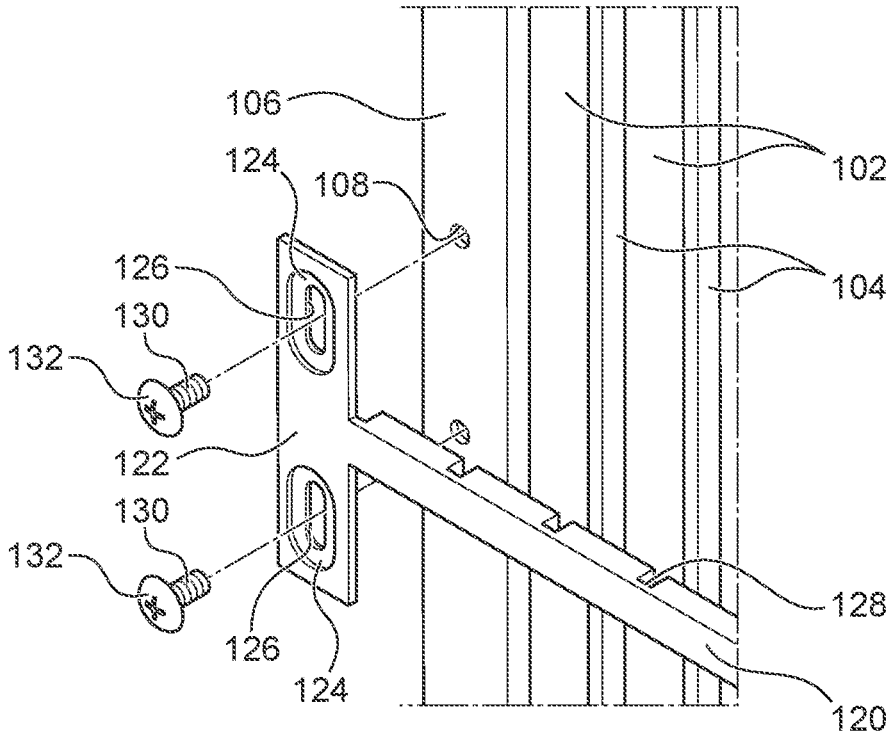
FIG. 5 is a perspective view illustrating a state before the rib illustrated in FIG. 4 is mounted on the paddle.
Figure 6:
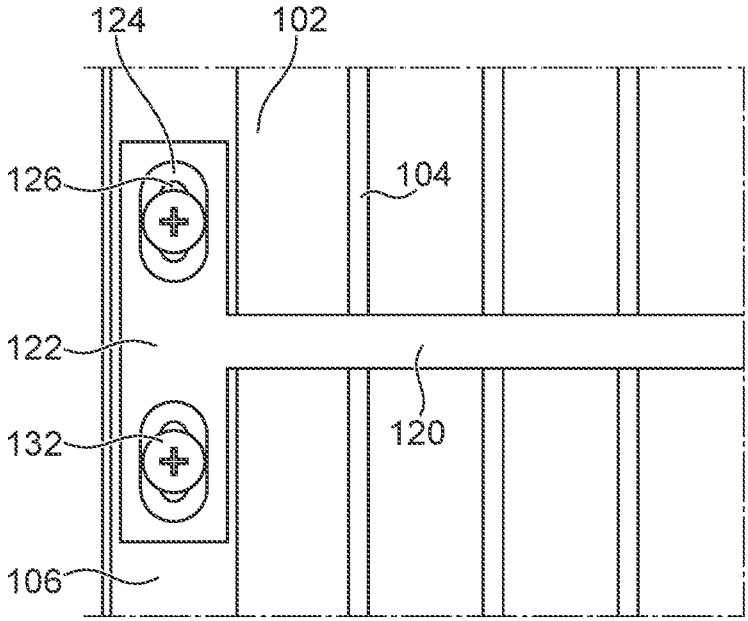
FIG. 6 is a front view illustrating a state where the rib illustrated in FIG. 4 has been mounted on the paddle.

In the one embodiment, as illustrated in FIG. 3, the paddle 100 includes ribs 120 extending in the lateral direction of the paddle 100 (the traverse direction of the elongated hole 102). In the embodiment in the drawing, two ribs 120 are disposed. In the one embodiment, the rib 120 can be removably mounted on the paddle 100. In the one embodiment, the rib 120 is configured such that its mounted position is adjustable in a height direction (an up-down direction in FIG. 3, the longitudinal direction of the elongated hole 102). In the embodiment in the drawing, the rib 120 is mounted on the outer peripheral portions 106 in the lateral direction. The rib 120 includes mounted portions 122 to be mounted on the paddle 100. In the embodiment in the drawing, the mounted portions 122 are T-shaped parts disposed on both ends of the rib 120. FIG. 4 is an enlarged perspective view illustrating the part of the mounted portion 122 of the rib 120. FIG. 5 is a perspective view illustrating a state before the rib 120 is mounted on the paddle 100. FIG. 6 is a front view illustrating a state where the rib 120 has been mounted on the paddle 100. As illustrated in FIG. 5, the mounted portion 122 has two depressed portions 124. The depressed portion 124 has a dimension that can receive a screw head 132 of a screw 130, which is described below. In the embodiment in the drawing, the depressed portion 124 is formed having a dimension larger than that of the screw head 132 in the height direction of the paddle 100. Respective through-holes 126 are formed on bottom surfaces of the respective depressed portions 124. In the embodiment in the drawing, the through-hole 126 is formed as an elongated hole that is large in the height direction of the paddle 100. A screw hole 108 that receives the screw 130 is formed on the outer peripheral portion 106 of the paddle 100. As illustrated in FIG. 5, when the rib 120 is mounted on the paddle 100, the screw 130 is inserted into the screw hole 108 of the paddle 100 through the through-hole 126 of the mounted portion 122 of the rib 120. The depressed portion 124 and the through-hole 126 of the mounted portion 122 have the large dimensions in the height direction of the paddle 100 to ensure adjustment of the mounted position on the paddle 100 of the rib 120 in the height direction. As illustrated in FIG. 4 and FIG. 5, the rib 120 has depressed portions 128 to be engaged with the grid portions 104 of the paddle 100. As illustrated in FIG. 4, in the state where the rib 120 has been mounted on the paddle 100, the surface of the rib 120 is projecting to a side of the anode 26.

Figure 7:
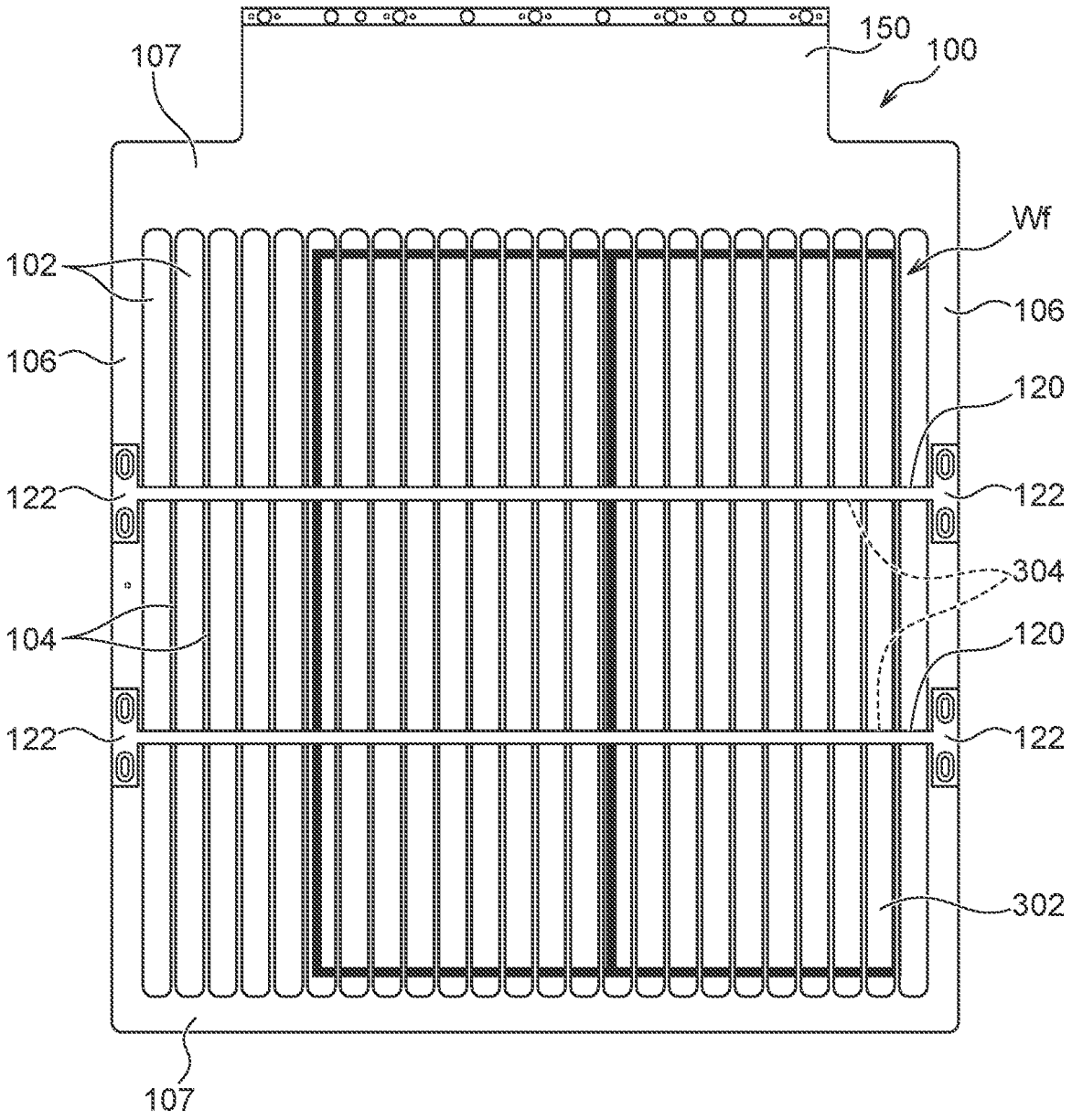
FIG. 7 is a front view illustrating the paddle on which the rib has been mounted together with the substrate according to the one embodiment.

FIG. 7 is a front view illustrating the paddle 100 on which the ribs 120 have been mounted together with the substrate Wf. FIG. 7 illustrates a relative arrangement of the paddle 100 and the substrate Wf when the substrate Wf is electroplated in the plating tank 10 as illustrated in FIG. 2. In FIG. 7, for clarity of the illustration, the configurations other than the paddle 100, the rib 120, and the substrate Wf are omitted. As illustrated in FIG. 7, the rib 120 has been mounted on the paddle 100 so as to overlap the non-pattern area 304 in the lateral direction in the inner region of the substrate Wf. In the embodiment in the drawing, the paddle 100 is reciprocated in a right-left direction in FIG. 7 to stir the plating solution Q in the plating tank 10. When the electroplating is performed, the electric field between the anode 26 and the substrate Wf is blocked by the rib 120. The rib 120 is extending in a movement direction of the paddle 100. Thus, the non-pattern area 304 in the lateral direction in the inner region of the substrate Wf will be constantly blocked by the rib 120 during the electroplating. Accordingly, in the non-pattern area 304 blocked by the rib 120, the electric field is blocked. Thus, a formed plating film will be thinly formed compared with a case without the rib 120. As described above, when there is the large non-pattern area inside the substrate Wf, the thickness of the formed plating film tends to increase in the plating area near the non-pattern area. In this embodiment, blocking the non-pattern area of the substrate can thin the film thickness of the plating formed near the non-pattern area, thus ensuring the formation of the plating film having a more uniform film thickness as a result. The rib 120 can improve a mechanical strength of the paddle 100. As described above, the position in the height direction of the rib 120 is adjustable and changeable corresponding to the position of the non-pattern area of the substrate Wf on which the electroplating is performed. The rib 120 is attachable to and removable from the paddle 100. Therefore, several types of ribs 120 having different widths (in the longitudinal direction) may be prepared to exchange the rib 120 for a rib 120 having an appropriate size according to the width of the non-pattern area 304 of the substrate Wf to be processed for use. As described above, the pattern area is the area used as the device on the substrate, and the non-pattern area is the area that is not used as the device on the substrate. To be used/not used as the device on the substrate means to be used/not used as a final device formed on the substrate. Therefore, in a phase in the middle of formation of the device on the substrate, dummy wiring and the like that do not function as the final device may be formed also on the non-pattern area that is not used as the final device. For example, in the electroplating, typically, a resist is applied over the substrate, and the plating film is formed on an opening of the resist. Usually, a part on which the plating film is formed becomes, for example, circuit wiring and an electrode to be a part of the final device. However, for reasons of, for example, uniformizing of the plating film, the opening of the resist is sometimes provided also on the non-pattern area that is not used as the final device to form the plating film also on the non-pattern area.

Figure 8:
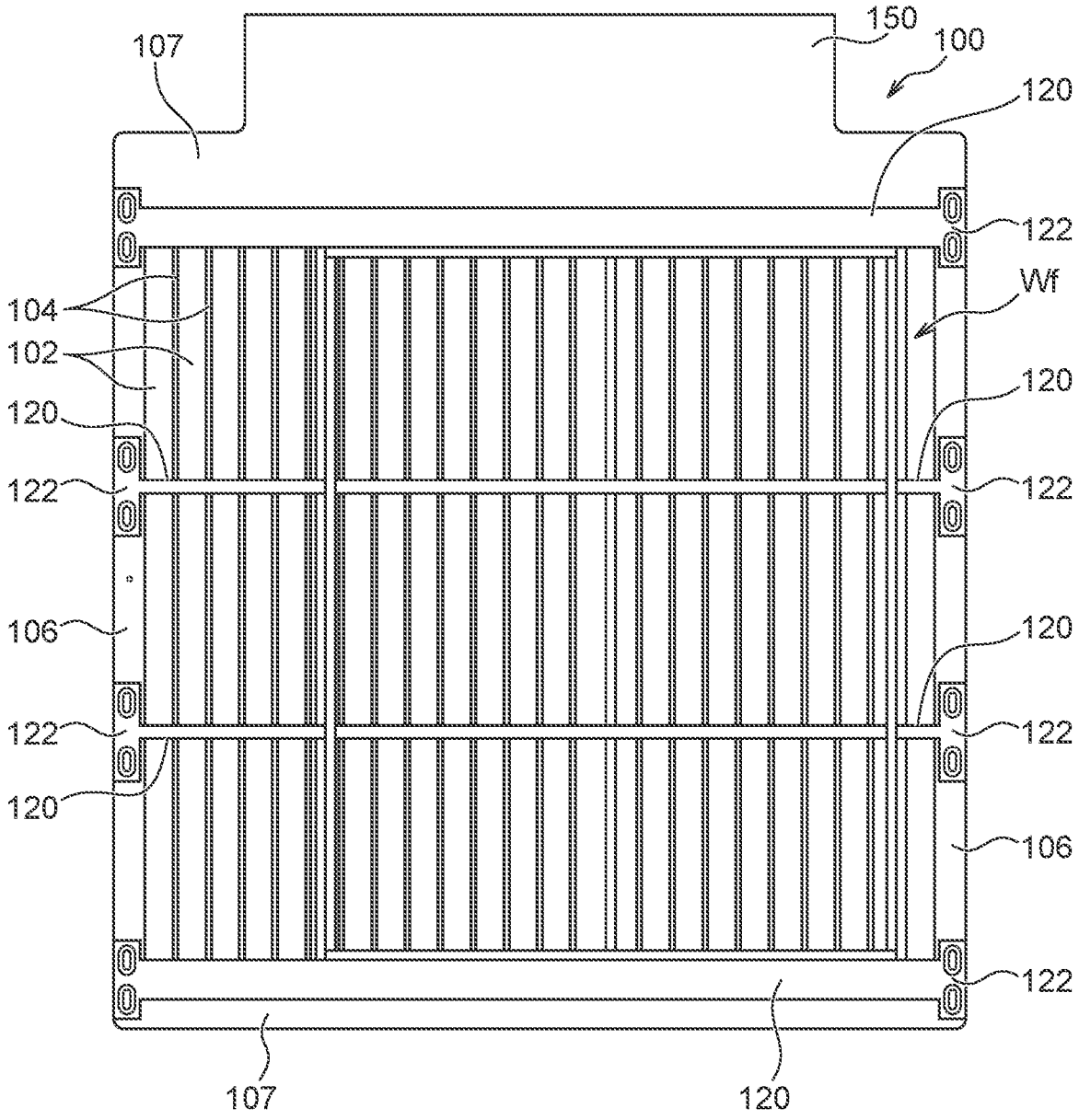
FIG. 8 is a front view illustrating the paddle on which the rib has been mounted according to one embodiment.

FIG. 8 is a front view illustrating the paddle 100 on which the ribs 120 have been mounted according to one embodiment. In the embodiment illustrated in FIG. 8, in addition to the two ribs 120 illustrated in FIGS. 3 and 7, ribs 120 arranged on an upper end and a lower end in an up-down direction of the elongated holes 102 of the paddle 100 are disposed. Dimensions of the ribs 120 arranged on the upper end and the lower end are optional and may be identical to or different from that of the above-described rib 120. The ribs 120 arranged on the upper end and the lower end can be mounted on the paddle 100 with a structure similar to that of the above-described rib 120. The ribs 120 arranged on the upper end and the lower end can always block the non-pattern areas 304 existing on an upper end and a lower end of the substrate Wf.

Figure 9:
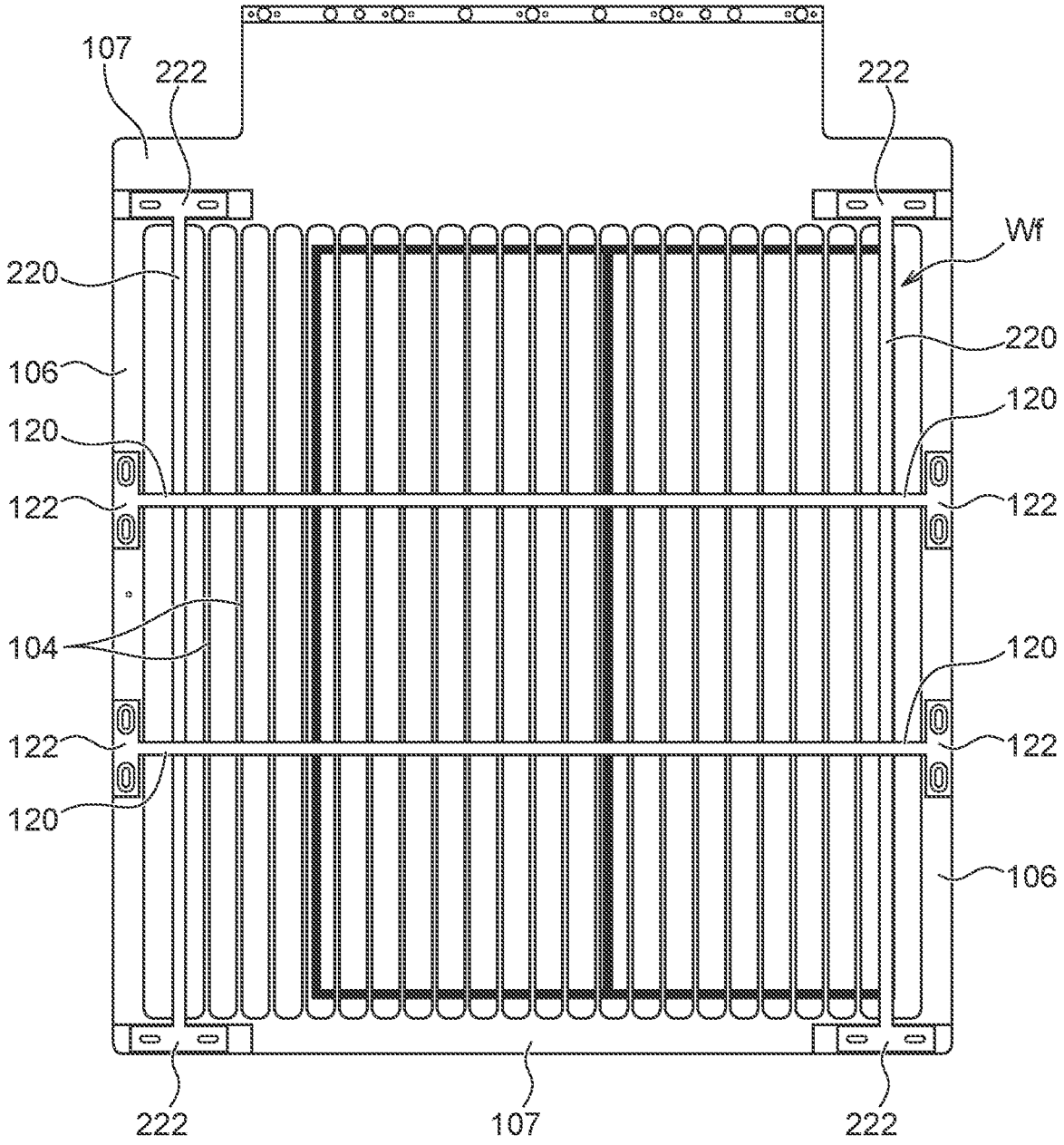
FIG. 9 is a front view illustrating the paddle on which the rib has been mounted according to one embodiment.

FIG. 9 is a front view illustrating the paddle 100 including ribs according to one embodiment. The paddle 100 in the embodiment illustrated in FIG. 9 includes longitudinal ribs 220 in the longitudinal direction in addition to the two ribs 120 in the lateral direction illustrated in FIG. 3 and FIG. 7.

Figure 10:
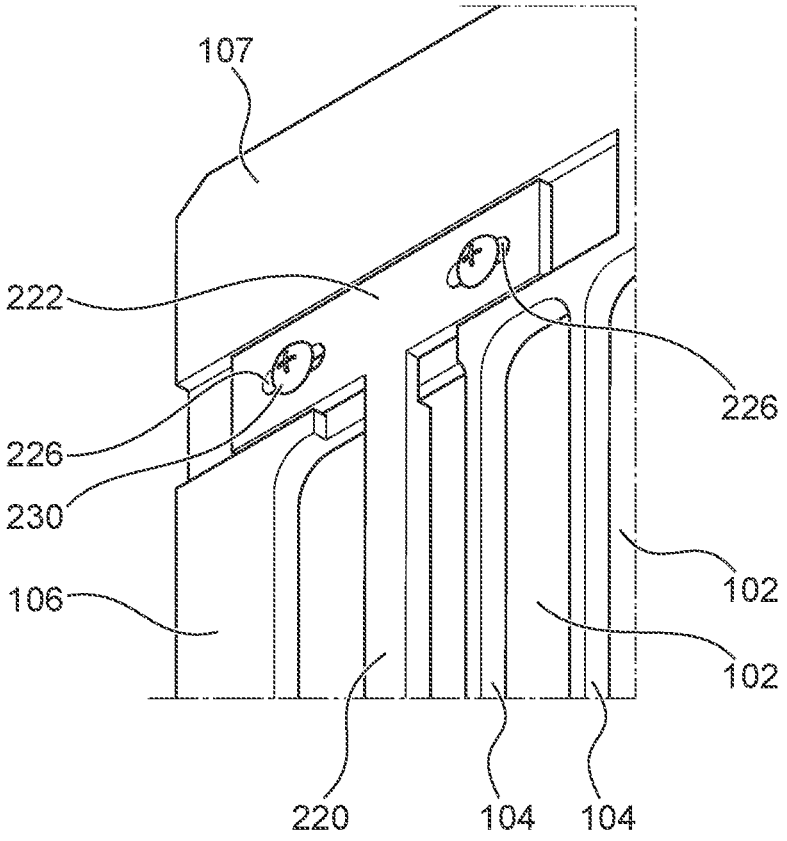
FIG. 10 is an enlarged perspective view illustrating a part of a mounted portion of a longitudinal rib illustrated in FIG. 9.
Figure 11:
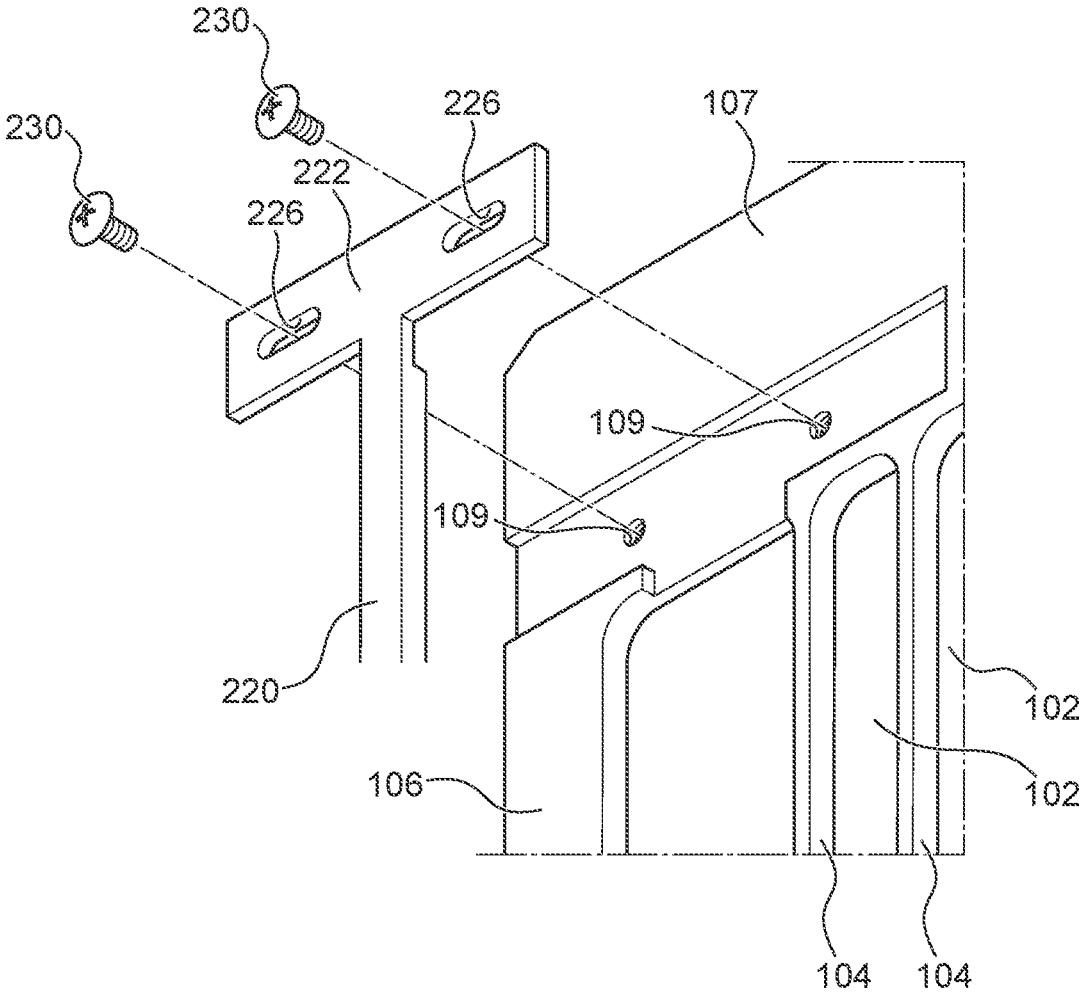
FIG. 11 is a perspective view illustrating a state before the longitudinal rib illustrated in FIG. 10 is mounted on the paddle.

In the embodiment illustrated in FIG. 9, the longitudinal rib 220 can be removably mounted on the paddle 100. In the one embodiment, the longitudinal rib 220 is configured such that the mounted position is adjustable in the lateral direction (a right-left direction in FIG. 9). In the embodiment in the drawing, the longitudinal rib 220 is mounted on the outer peripheral portions 107 in the longitudinal direction. The longitudinal rib 220 includes mounted portions 222 to be mounted on the paddle 100. In the embodiment in the drawing, the mounted portions 222 are T-shaped parts disposed on both ends of the longitudinal rib 220. FIG. 10 is an enlarged perspective view illustrating the part of the mounted portion 222 of the longitudinal rib 220. FIG. 11 is a perspective view illustrating a state before the longitudinal rib 220 is mounted on the paddle 100. As illustrated in FIG. 11, the mounted portion 222 has through-holes 226. In the embodiment in the drawing, the through-hole 226 is formed as an elongated hole that is large in the lateral direction of the paddle 100. Screw holes 109 that receive screws 230 are formed on the outer peripheral portion 107 in the longitudinal direction of the paddle 100. As illustrated in FIG. 11, when the longitudinal rib 220 is mounted on the paddle 100, the screw 230 is inserted into the screw hole 109 of the paddle 100 through the through-hole 226 of the mounted portion 222. The through-hole 126 of the mounted portion 222 has a large dimension in the lateral direction of the paddle 100 with respect to the screw 230. Thus, the mounted position on the paddle 100 of the longitudinal rib 220 can be adjusted in the lateral direction. As illustrated in FIG. 10 and FIG. 11, the dimension (width) in the lateral direction of the longitudinal rib 220 is larger than the dimension in the lateral direction of the grid portion 104 of the paddle 100. However, as one embodiment, the width of the longitudinal rib 220 may be identical to or narrower than the width of the grid portion 104. In the embodiment illustrated in FIG. 10, the dimension in a depth direction of the longitudinal rib 220 (the right-left direction in FIG. 2) is identical to the dimension in a depth direction of the grid portion 104 of the paddle 100. In other words, the longitudinal rib 220 in FIG. 10 does not project toward the anode 26 side like the rib 120 in the lateral direction illustrated in FIG. 4. The surface of the longitudinal rib 220 and the surface of the grid portion 104 illustrated in FIG. 4 are on an identical level, that is, exist on an identical surface. The mounted portion 222 of the longitudinal rib 220 illustrated in FIG. 9 to FIG. 11, similarly to the mounted portion 122 of the rib 120 illustrated in FIGS. 4 and 5, may be configured to have depressed portions to form the through-holes 226 on bottom surfaces of the depressed portions. In FIG. 9, both of the ribs 120 in the lateral direction and the longitudinal ribs 220 in the longitudinal direction are mounted on the paddle 100. However, as another embodiment, only the longitudinal ribs 220 in the longitudinal direction may be mounted on the paddle 100.

FIG. 9 illustrates the paddle 100 on which the longitudinal ribs 220 have been mounted together with the substrate. FIG. 9 illustrates a relative arrangement of the paddle 100 and the substrate Wf when the substrate Wf is electroplated in the plating tank 10 as illustrated in FIG. 2. In FIG. 9, for clarity of the illustration, the configurations other than the paddle 100, the rib 120, the longitudinal rib 220, and the substrate Wf are omitted. The paddle 100 illustrated in FIG. 9 is reciprocated in the right-left direction in the plating tank 10 to stir the plating solution Q in the plating tank 10. The stroke of the reciprocation of the paddle 100 on which the longitudinal rib 220 is mounted is determined such that the longitudinal rib 220 overlaps the non-pattern area 304 in the outer region in the right-left direction of the substrate Wf when they are viewed from the anode 26 side, when the paddle 100 is positioned on a stroke end. In FIG. 9, the paddle 100 is positioned on a stroke end in the left direction, and the right-side longitudinal rib 220 overlaps the non-pattern area 304 in the longitudinal direction on the right side of the substrate Wf. The paddle 100 rightward moves from the stroke end illustrated in FIG. 9 and then moves up to a stroke end on an opposite side where the left-side longitudinal rib 220 overlaps the non-pattern area 304 in the longitudinal direction on the left side of the substrate Wf. Therefore, when the paddle 100 is positioned on the stroke end, the longitudinal rib 220 overlaps the non-pattern area 304 in the longitudinal direction in the outer region of the substrate Wf. When the paddle 100 is reciprocated, the paddle 100 instantaneously stops at the stroke end. Therefore, in the electroplating, when the paddle 100 is positioned on the stroke end, the electric field between the anode 26 and the substrate Wf is blocked by the longitudinal rib 220. Accordingly, in the non-pattern area blocked by the longitudinal rib 220 at the stroke end, since the electric field is temporarily blocked, a formed plating film is thinly formed compared with a case without the longitudinal rib 220. As described above, when there is the large non-pattern area inside the substrate Wf, the thickness of the formed plating film tends to increase in the plating area near the non-pattern area. In this embodiment, blocking the non-pattern area of the substrate can thin the film thickness of the plating formed near the non-pattern area, thus ensuring the formation of the plating film having a more uniform film thickness as a result. As described above, the position in the lateral direction of the longitudinal rib 220 is adjustable and changeable corresponding to the position of the non-pattern area of the substrate Wf on which the electroplating is performed.

Figure 12:
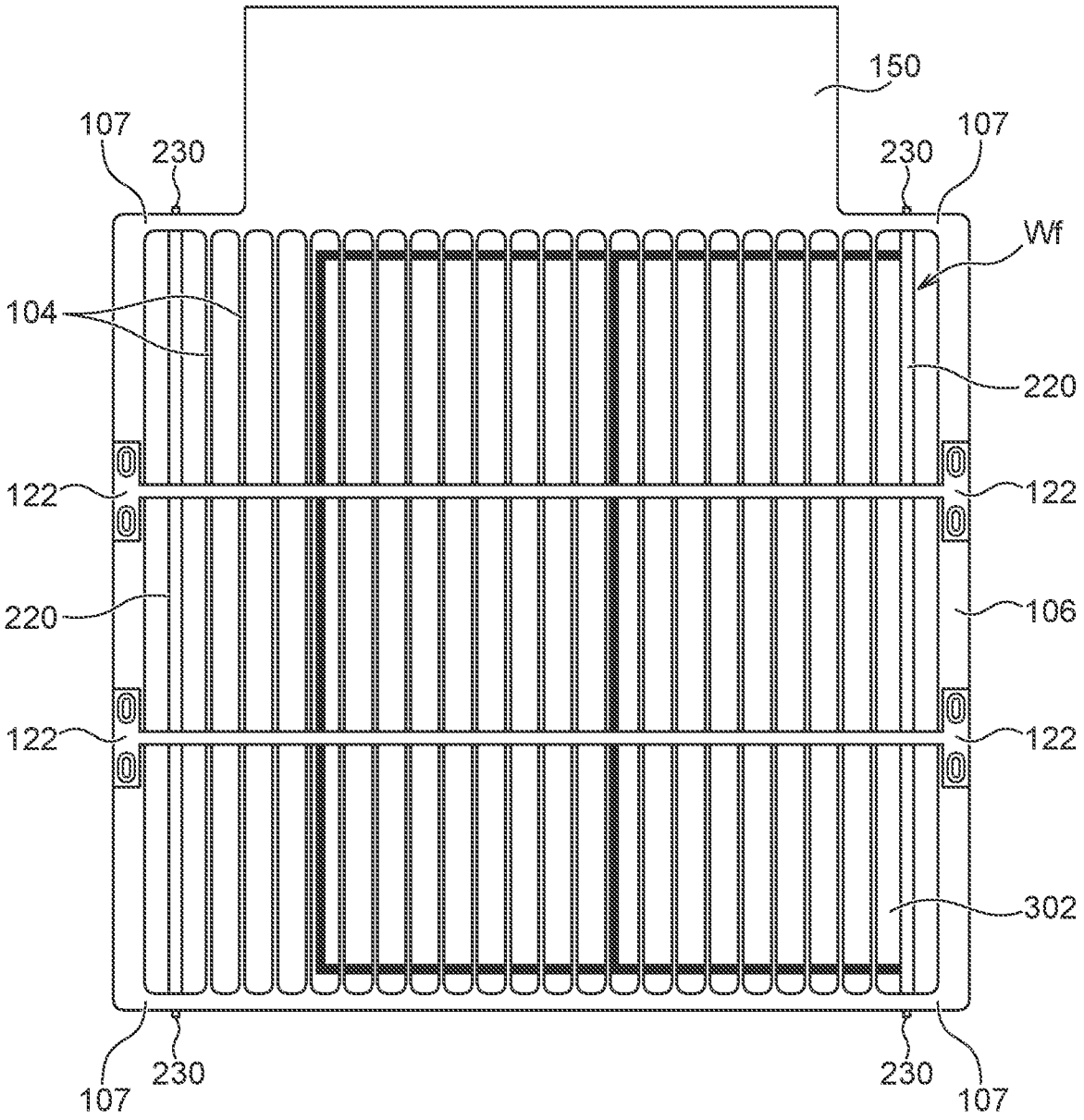
FIG. 12 is a front view illustrating the paddle including the longitudinal rib according to one embodiment.

FIG. 12 is a front view illustrating the paddle 100 including the longitudinal ribs 220 according to one embodiment. The paddle 100 in the embodiment illustrated in FIG. 12 includes the longitudinal ribs 220 in the longitudinal direction in addition to the two ribs 120 in the lateral direction illustrated in FIG. 3 and FIG. 7. The longitudinal rib 220 in the embodiment illustrated in FIG. 12 can be similar to the longitudinal rib 220 illustrated in FIG. 9 to FIG. 11 excluding the mounted portion 222. Therefore, in the embodiment in FIG. 12, the description except for the mounted portion 222 is omitted.

Figure 13:
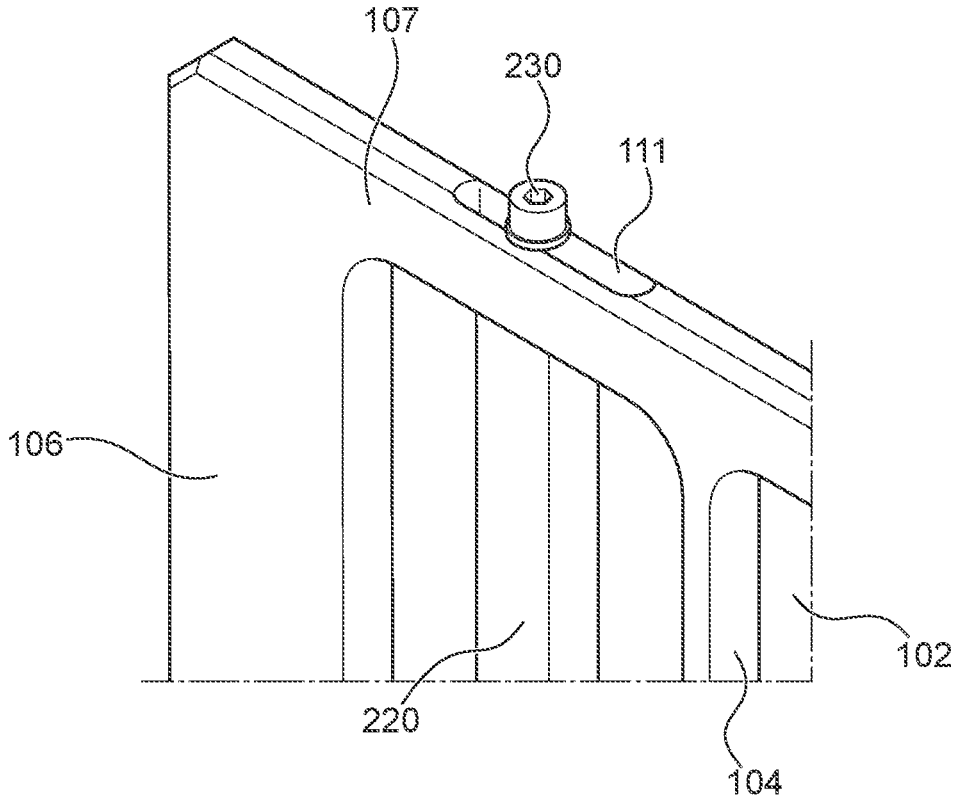
FIG. 13 is an enlarged perspective view illustrating a part of a mounted portion of the longitudinal rib illustrated in FIG. 12.
Figure 14:
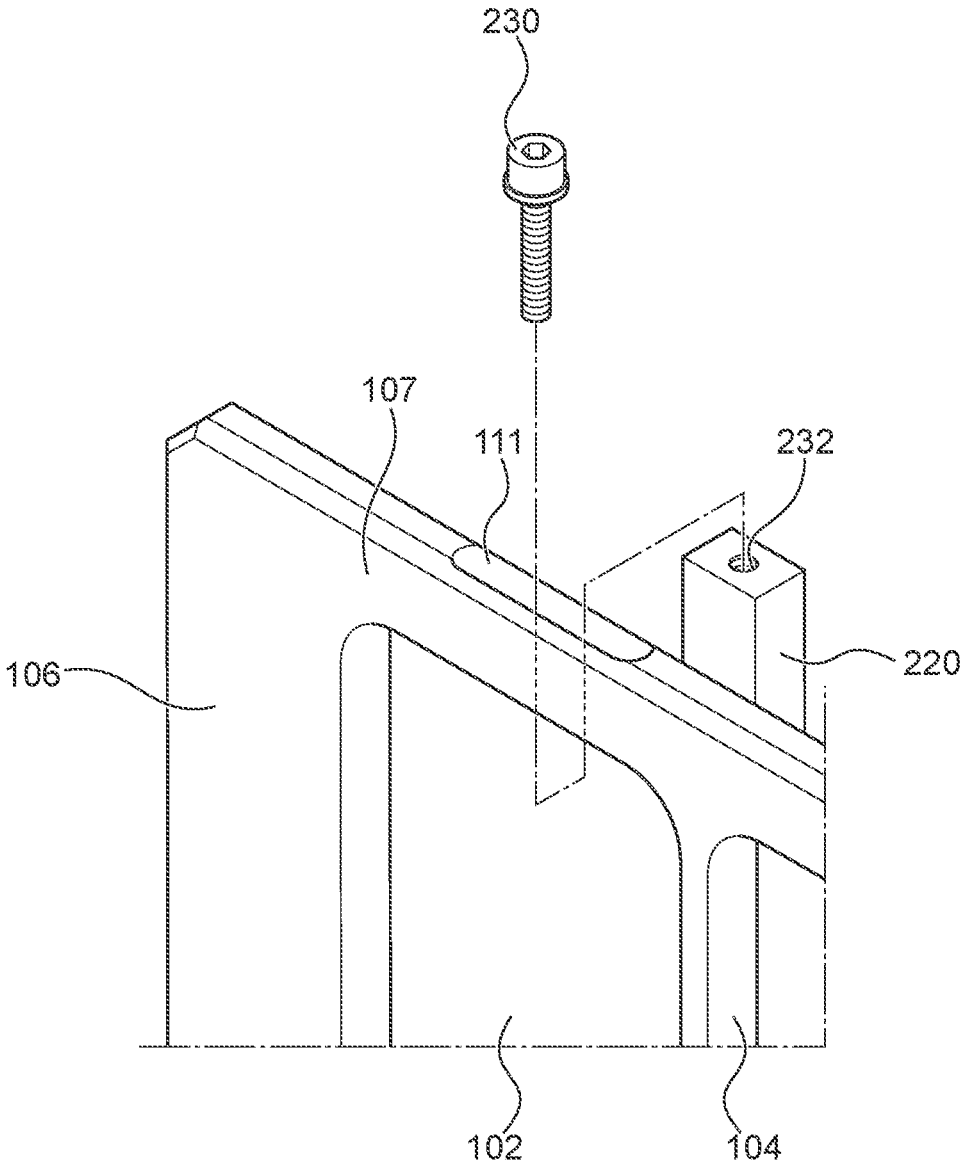
FIG. 14 is a perspective view illustrating a state before the longitudinal rib illustrated in FIG. 13 is mounted on the paddle.

In the embodiment illustrated in FIG. 12, the longitudinal rib 220 can be removably mounted on the paddle 100. In the one embodiment, the longitudinal rib 220 is configured such that the mounted position is adjustable in the lateral direction (a right-left direction in FIG. 12). FIG. 13 is an enlarged perspective view illustrating a part of the mounted portion 222 of the longitudinal rib 220. FIG. 14 is a perspective view illustrating a state before the longitudinal rib 220 is mounted on the paddle 100. In the embodiment in the drawing, the longitudinal rib 220 is mounted on the outer peripheral portions 107 in the longitudinal direction of the paddle 100. As illustrated in FIG. 13 and FIG. 14, a through-hole 111 extending in the longitudinal direction is formed on the outer peripheral portion 107 of the paddle 100. As illustrated in FIG. 14, a screw hole 232 is formed on an end portion in the longitudinal direction of the longitudinal rib 220. As illustrated in FIG. 14, when the longitudinal rib 220 is mounted on the paddle 100, the screw 230 is inserted into the screw hole 232 of the longitudinal rib 220 through the through-hole 111 formed on the outer peripheral portion 107. The through-hole 111 of the outer peripheral portion 107 has a large dimension in the lateral direction with respect to the screw 230. Thus, the mounted position on the paddle 100 of the longitudinal rib 220 can be adjusted in the lateral direction.

Figure 15:
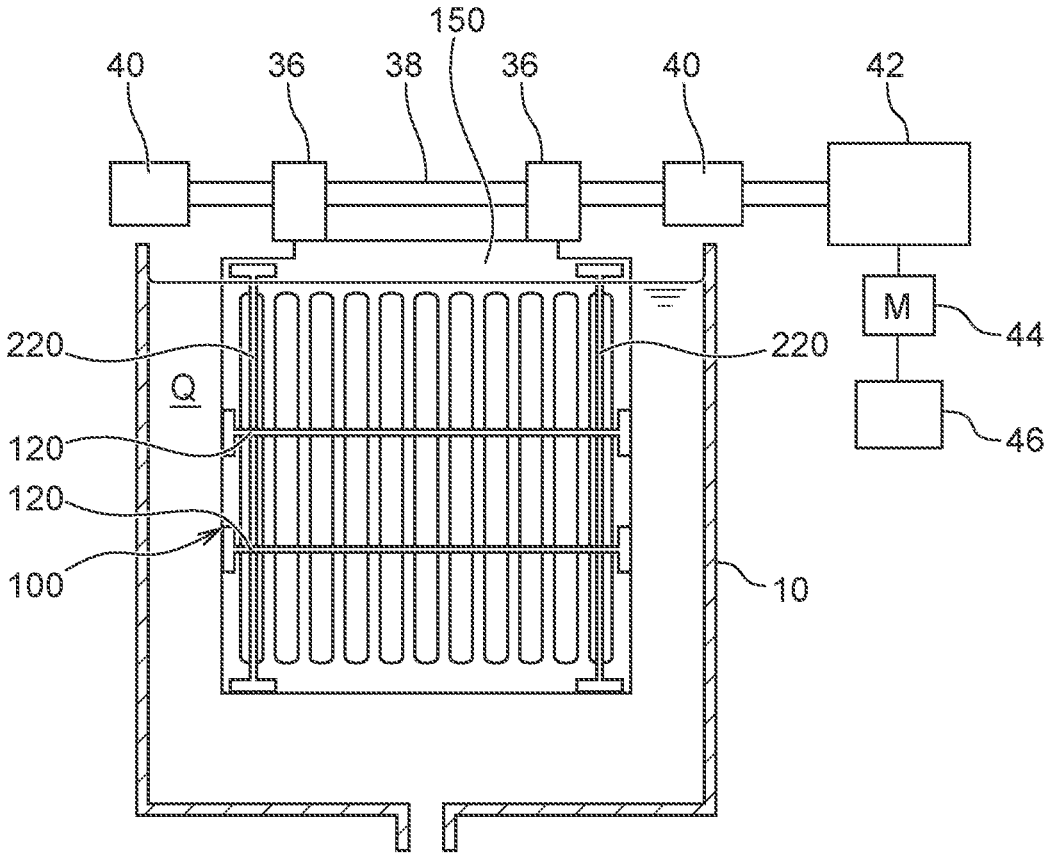
FIG. 15 is a drawing illustrating a driving mechanism for the paddle together with a plating tank according to one embodiment.

FIG. 15 is a drawing illustrating a driving mechanism for the paddle 100 together with the plating tank 10. The paddle 100 is secured to a shaft 38 extending in a horizontal direction with the clamps 36 secured to the neck portion 150 of the paddle 100. The shaft 38 is configured to slide to right and left with being held onto shaft holding portions 40. The shaft 38 has an end portion connected to a paddle driving portion 42 that causes the paddle 100 to do linear reciprocating motion to right and left. The paddle driving portion 42 can, for example, convert rotation of a motor 44 into the linear reciprocating motion of the shaft 38 with a crank mechanism (not illustrated). In this example, a control unit 46, which controls a rotation speed of the motor 44 of the paddle driving portion 42 to control the moving speed of the paddle 100, is disposed. A reciprocation speed of the paddle 100 is optional. However, for example, the reciprocation speed of the paddle 100 can be a speed of about 250 strokes/minute to about 400 strokes/minute. The mechanism of the paddle driving portion 42 may be not only the crank mechanism but also a mechanism that converts rotation of a servo motor into the linear reciprocating motion of a shaft with a ball screw and a mechanism that causes a shaft to do the linear reciprocating motion with a linear motor. When the paddle 100 includes the longitudinal rib 220, as described above, a movement range of the paddle 100 is determined such that the longitudinal rib 220 overlaps the non-pattern area 304 in the longitudinal direction of the substrate Wf at the stroke end of the reciprocation of the paddle 100. The control unit 46 preferably returns the right and left positions of the paddle 100 to predetermined origin positions each time the substrate Wf is processed. This can avoid variation in the effect of blocking of the electric field by the rib 120 or the longitudinal rib 220 for respective processed substrates.

From the above-described embodiments, at least the following technical ideas are obtained.

[Configuration 1]

According to a configuration 1, a paddle for use of stirring a plating solution used in electroplating is provided. The paddle includes an outer peripheral portion and a rib attachable to and removable from the outer peripheral portion.

[Configuration 2]

According to a configuration 2, in the paddle according to the configuration 1, a position where the rib is attached to the outer peripheral portion is adjustable.

[Configuration 3]

According to a configuration 3, in the paddle according to the configuration 1 or 2, the rib is attached to the outer peripheral portion so as to extend in a direction where the paddle moves when the paddle stirs the plating solution.

[Configuration 4]

According to a configuration 4, in the paddle according to any one of the configurations 1 to 3, the rib is attached to the outer peripheral portion at a position such that the rib blocks a non-pattern area of a substrate as a plating object when the paddle is viewed from an anode in the electroplating.

[Configuration 5]

According to a configuration 5, in the paddle according to any one of the configurations 1 to 4, the rib is configured to project from the outer peripheral portion in a state where the rib is attached to the outer peripheral portion.

[Configuration 6]

According to a configuration 6, a plating apparatus for electroplating a substrate including a non-pattern area is provided. The plating apparatus includes a plating tank for holding a plating solution, an anode configured to be connected to a positive electrode of a power supply, and a paddle configured to move in the plating tank to stir the plating solution held in the plating tank. The paddle is configured such that at least a part of the non-pattern area of the substrate is constantly blocked when the paddle is viewed from the anode while the paddle is stirring the plating solution.

[Configuration 7]

According to a configuration 7, in the plating apparatus according to the configuration 6, the paddle includes an outer peripheral portion and a rib. The paddle is configured such that at least a part of the non-pattern area of the substrate is constantly blocked by the rib when the paddle is viewed from the anode while the paddle is stirring the plating solution.

[Configuration 8]

According to a configuration 8, in the plating apparatus according to the configuration 7, the rib is configured to be attachable to and removable from the outer peripheral portion.

[Configuration 9]

According to a configuration 9, in the plating apparatus according to the configuration 8, a position where the rib is attached to the outer peripheral portion is adjustable.

[Configuration 10]

According to a configuration 10, in the plating apparatus according to any one of the configurations 6 to 9, the rib extends in a direction where the paddle moves when the paddle stirs the plating solution.

[Configuration 11]

According to a configuration 11, in the plating apparatus according to any one of the configurations 7 to 10, the rib is configured to project toward a side of the anode from the outer peripheral portion.

[Configuration 12]

According to a configuration 12, a plating method for electroplating a substrate including a non-pattern area is provided. The method includes a step of holding an anode and a plating solution in a plating tank, a step of immersing the substrate in the plating solution in the plating tank, and a step of stirring the plating solution in the plating tank by moving a paddle in the plating solution. The method moves the paddle such that at least a part of the non-pattern area of the substrate is constantly blocked when the paddle is viewed from the anode while stirring the plating solution.

[Configuration 13]

According to a configuration 13, in the method according to the configuration 12, the step of stirring the plating solution includes a step of reciprocating the paddle.

The embodiment of the present invention has been described above based on some examples in order to facilitate understanding of the present invention without limiting the present invention. The present invention can be changed or improved without departing from the gist thereof, and of course, the equivalents of the present invention are included in the present invention. It is possible to arbitrarily combine or omit respective components according to claims and description in a range in which at least a part of the above-described problems can be solved, or a range in which at least a part of the effects can be exhibited.

REFERENCE SIGNS LIST

10 . . . plating tank
12 . . . overflow tank
26 . . . anode
30 . . . power supply
34 . . . regulation plate
100 . . . paddle
102 . . . elongated hole
104 . . . grid portion
106 . . . outer peripheral portion
107 . . . outer peripheral portion
120 . . . rib
122 . . . mounted portion
130 . . . screw
220 . . . longitudinal rib
222 . . . mounted portion
230 . . . screw

302 . . . pattern area

304 . . . non-pattern area

Wf . . . substrate

What is claimed is:

1. A plating apparatus for electroplating a substrate including a non-pattern area, the plating apparatus comprising:

a plating tank for holding a plating solution;

an anode configured to be connected to a positive electrode of a power supply; and a paddle configured to move in the plating tank to stir the plating solution held in the plating tank, wherein the paddle is configured such that at least a part of the non-pattern area of the substrate is constantly blocked when the paddle is viewed from the anode while the paddle is stirring the plating solution, wherein the paddle includes an outer peripheral portion and a rib, the paddle being configured such that at least a part of the non-pattern area of the substrate is constantly blocked by the rib when the paddle is viewed from the anode while the paddle is stirring the plating solution, the rib is configured to be attachable to and removable from the outer peripheral portion.

2. The plating apparatus according to claim 1, wherein a position where the rib is attached to the outer peripheral portion is adjustable.

3. The plating apparatus according to claim 1, wherein the rib extends in a direction where the paddle moves when the paddle stirs the plating solution.

4. The plating apparatus according to claim 1, wherein the rib is configured to project toward a side of the anode from the outer peripheral portion.

* * * * *